US008979257B2

(12) United States Patent
Cofler et al.

(10) Patent No.: US 8,979,257 B2
(45) Date of Patent: Mar. 17, 2015

(54) PRINTING OR COATING APPARATUS AND METHOD

(75) Inventors: Marian Cofler, Lod (IL); Alex Veis, Kadima (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1529 days.

(21) Appl. No.: 12/371,169

(22) Filed: Feb. 13, 2009

(65) Prior Publication Data

US 2009/0207223 A1 Aug. 20, 2009

Related U.S. Application Data

(60) Provisional application No. 61/032,094, filed on Feb. 28, 2008, provisional application No. 61/028,541, filed on Feb. 14, 2008.

(51) Int. Cl.

| | |
|---|---|
| ***B41J 2/01*** | (2006.01) |
| ***B41J 3/28*** | (2006.01) |
| ***B41J 11/00*** | (2006.01) |
| ***B41J 13/00*** | (2006.01) |

(52) U.S. Cl.

CPC ..... *B41J 3/28* (2013.01); *B41J 11/0015* (2013.01); *B41J 11/002* (2013.01); *B41J 13/0072* (2013.01)

USPC ..... 347/102

(58) Field of Classification Search

USPC ..... 347/102

See application file for complete search history.

(56) References Cited

U.S. PATENT DOCUMENTS

| | | | | |
|---|---|---|---|---|
| 6,491,364 | B2 * | 12/2002 | Pietrzyk et al. | 347/21 |
| 6,507,031 | B1 * | 1/2003 | Jinbo et al. | 250/455.11 |
| 6,550,905 | B1 * | 4/2003 | Deckers | 347/100 |
| 6,621,087 | B1 * | 9/2003 | Bisges et al. | 250/492.1 |
| 6,786,589 | B2 * | 9/2004 | Suzuki et al. | 347/102 |
| 7,021,754 | B2 * | 4/2006 | Takabayashi | 347/102 |
| 7,131,723 | B2 * | 11/2006 | Hoshino | 347/102 |
| 7,137,695 | B2 * | 11/2006 | Yokoyama | 347/102 |
| 7,140,711 | B2 * | 11/2006 | Nerad et al. | 347/19 |
| 7,690,781 | B2 * | 4/2010 | Ohnishi | 347/102 |
| 8,287,116 | B2 | 10/2012 | Cofler | |
| 2003/0164870 | A1 * | 9/2003 | Yamamoto | 347/102 |
| 2004/0166249 | A1 * | 8/2004 | Siegel | 427/558 |
| 2004/0189770 | A1 * | 9/2004 | Hintermann | 347/102 |
| 2005/0280683 | A1 * | 12/2005 | Custer | 347/102 |
| 2009/0004401 | A1 * | 1/2009 | Nojo et al. | 427/508 |
| 2009/0115827 | A1 * | 5/2009 | Endo et al. | 347/102 |
| 2009/0207224 | A1 | 8/2009 | Cofler | |

FOREIGN PATENT DOCUMENTS

| | | | |
|---|---|---|---|
| WO | WO-2004/056581 | * | 7/2004 |
| WO | WO-2005/100037 | | 10/2005 |
| WO | WO-2006/098478 | * | 9/2006 |
| WO | WO-2007/090040 | | 8/2007 |

* cited by examiner

*Primary Examiner* — Alessandro Amari
*Assistant Examiner* — Jeremy Bishop

(57) ABSTRACT

An inkjet printing apparatus for printing on a substrate comprises a first support, which is a substrate support, and a second support which supports at least one inkjet printing head, at least one UV source of ultraviolet radiation, and at least one gas dispenser. The second support is moveable relative to a substrate supported by the first support. The printing head deposits ink on the substrate and the UV source cures the deposited ink. The gas dispenser is arranged to provide a layer of gas, which is at least depleted of oxygen, between the UV source and the substrate.

11 Claims, 10 Drawing Sheets

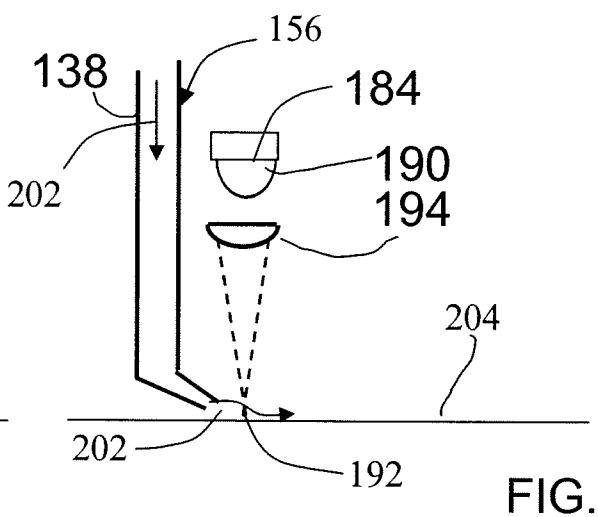
FIG. 4B1
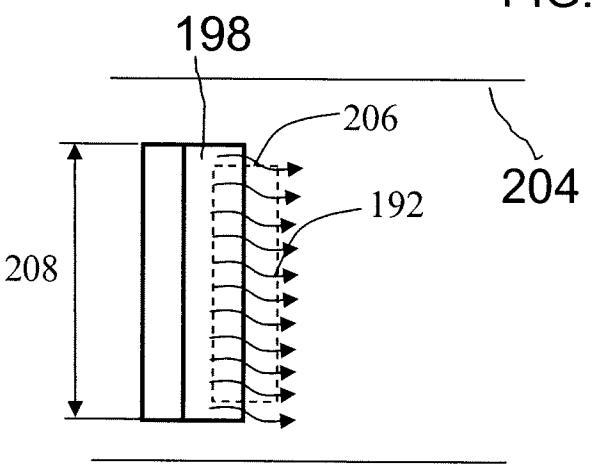
FIG. 4B2
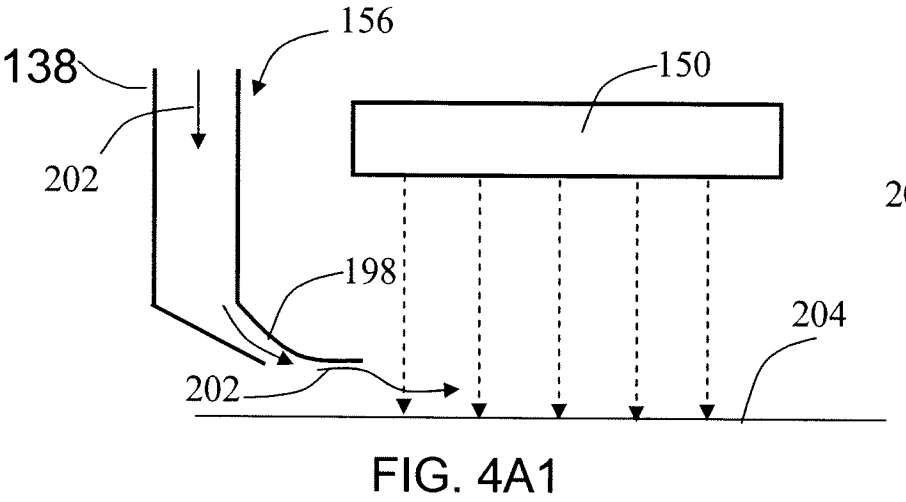
FIG. 4A1
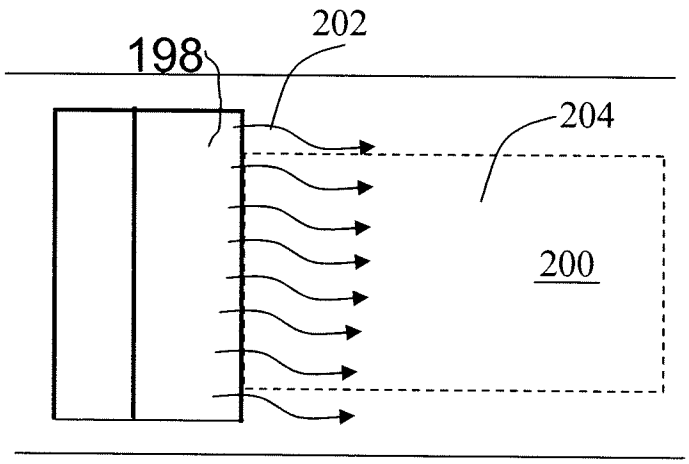
FIG. 4A2

PRINTING OR COATING APPARATUS AND METHOD

This application claims the benefit of U.S. provisional application Ser. Nos. 61/028,541, filed Feb. 14, 2008 and 61/032,094 filed Feb. 28, 2008. The entire contents of the aforementioned applications are incorporated herein by reference.

TECHNICAL FIELD

The present invention relates to a method of, and apparatus for, printing on or coating a substrate. An embodiment of the invention relates to a printing apparatus or method for use with UV curable inks. Another embodiment relates to an apparatus or method for applying a UV curable coating to a substrate.

BACKGROUND

Inkjet printing is widely used for printing of billboards, banners and point of sale displays. The ink-jet printing process involves manipulation of drops of ink ejected from an orifice or a number of orifices of a print head onto an adjacent print substrate. Paper, vinyl, textiles, fabrics, and others are examples of print substrates. Relative movement between the substrate and the print head enables substrate coverage and image creation. A number of platens forming so-called substrate feed path carries out substrate transportation. Alternatively, the substrate may be located on a moving support usually termed flat bed support and moved together with the support. The print head typically reciprocates over the recording substrate ejecting ink droplets forming a section of an image or a swath at each path. After each reciprocating movement or pass, the substrate is further transported to a position where the next section of a desired image may be printed on it.

Printed ink should be dried or cured. Curable inks are more popular since they generate a light and waterproof image characterized by vivid colors. Curing radiation sources, such as UV lamps, may be static illuminating the whole width of printed image or associated with the print head and move with it. Ink curing requires large amounts of UV radiation and accordingly powerful UV sources are used to cure ink. There is a growing demand for faster printers printing on a variety of substrates including heat sensitive substrates. There is however a limit to the power and size of UV lamps that could be produced.

Instead of UV lamps, LEDs which emit UV radiation may be used. However an LED typically has a lower power output than a UV lamp.

In order to enable faster printing with UV curable inks it is necessary either to reduce the curing UV power or provide a more sensitive ink. Ink that is more sensitive has shorter shelf time, more toxic and more expensive. There is a need to provide a method of printing with UV curable ink free of the above drawbacks. There is a similar need associated with coating apparatus which uses a UV curable coating.

The apparatus and the method are particularly pointed out and distinctly claimed in the concluding portion of the specification.

BRIEF DESCRIPTION OF THE DRAWINGS for a better understanding of the present invention reference will now be made by way of example to the accompanying drawings in which.

Figure 1A:
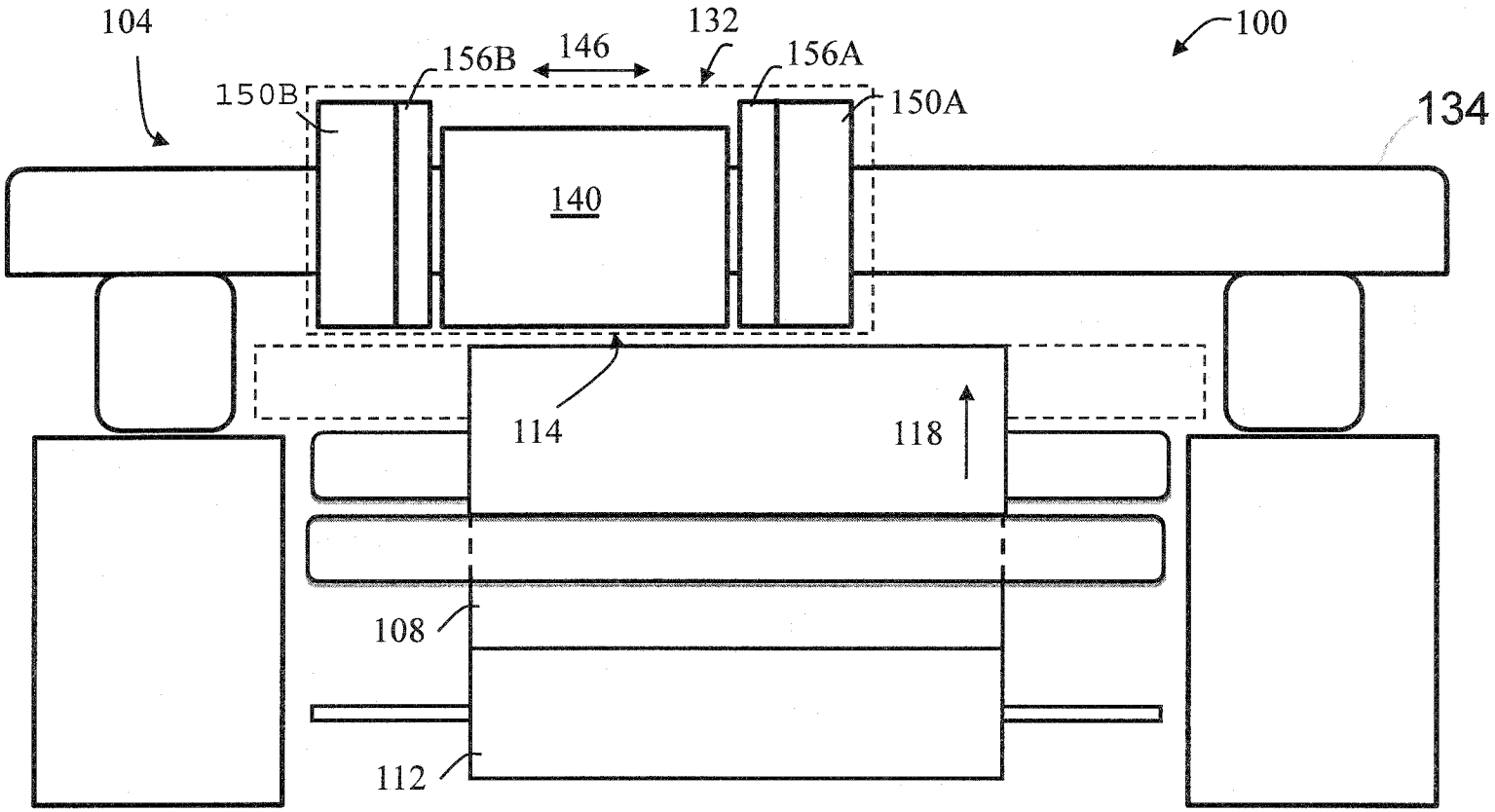
FIG. 1A is a schematic illustration of an embodiment of a roll-to-roll inkjet printer operating with UV curable inks.
Figure 1B:
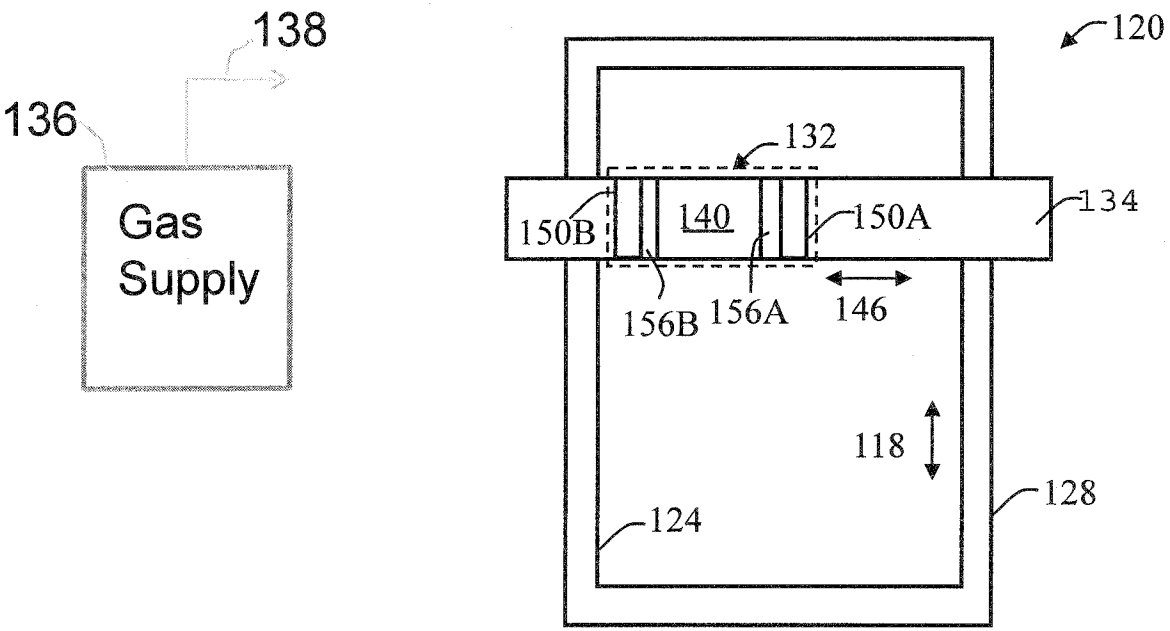
FIG. 1B is a schematic illustration of an embodiment of a flat bed ink jet printer operating with UV curable inks.
Figure 2B:
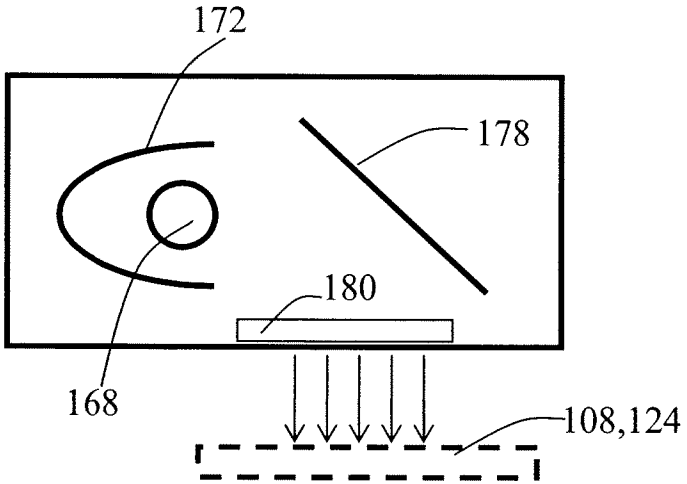
FIGS. 2A and 2B are schematic illustrations of embodiments of a UV lamp based curing energy source of the printer of FIG. 1.
Figure 5:
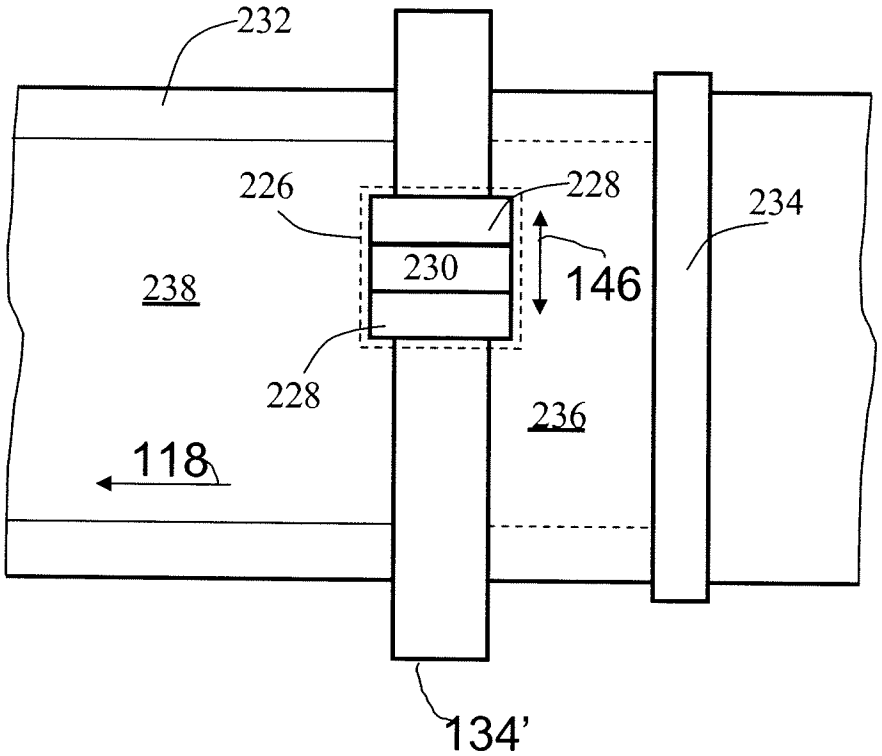
Figure 6:
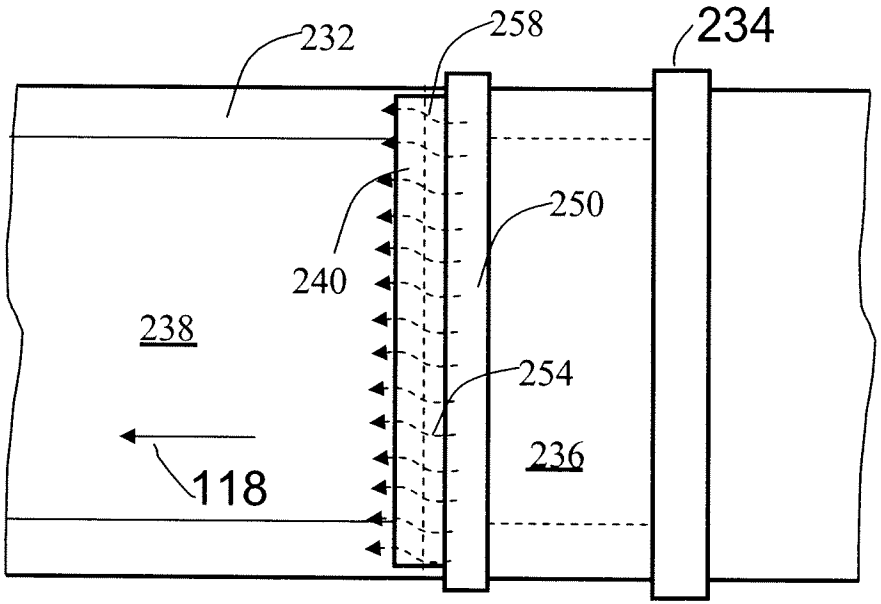
Figure 7:
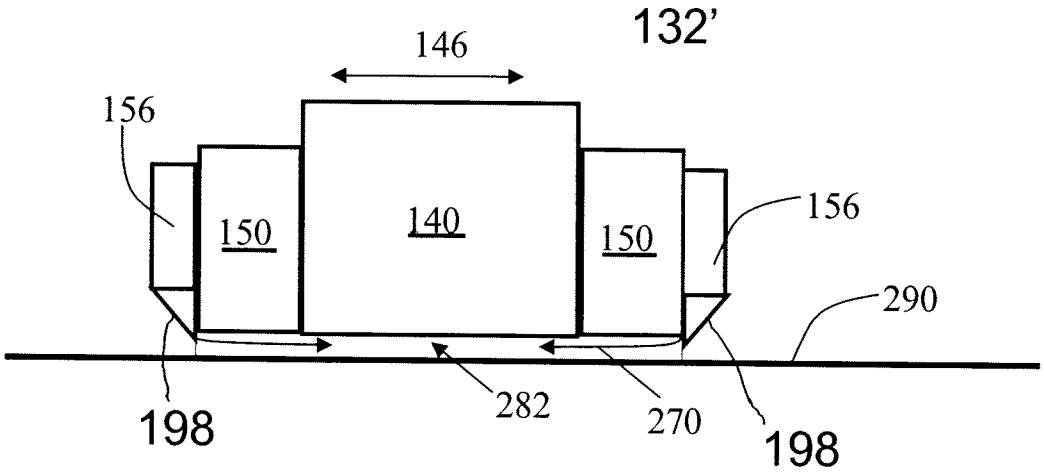
Figure 8:
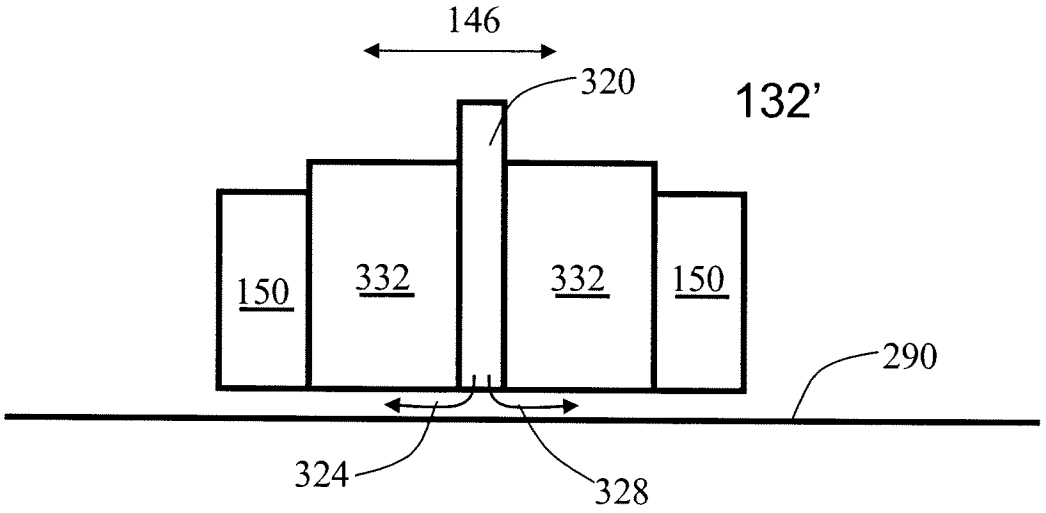

FIGS. 4A1 and 4A2 are elevational and plan views respectively of an arrangement of a gas dispenser and a UV source;

FIGS. 4B1 and 4B2 are elevational and plan views respectively of another arrangement of a gas dispenser and a UV source;

FIG. 5 is a schematic illustration of a further exemplary embodiment of a printer with a UV source coupled with an inert gas source;

FIG. 6 is a schematic illustration of yet another exemplary embodiment of a printer with a UV source coupled with an inert gas source;

FIG. 7 is a schematic illustration of an alternative carriage which may be used in the embodiments of FIGS. 1A and 1B; and FIG. 8 is a schematic illustration of another alternative carriage which may be used in the embodiments of FIGS. 1A and 1B.

DETAILED DESCRIPTION OF ILLUSTRATIVE EMBODIMENTS

Reference is made to FIG. 1A, which is a schematic illustration of an inkjet printer operating with UV curable inks. Printer 100 is a wide format printer printing on a wide flexible substrate. Printer 100 may be of any known type such as for example, a roll-to-roll printer 104 that typically pulls a flexible printing substrate 108 from a supply roll 112 over a substrate support area to a receiving roll (not shown). A drive is provided for moving the substrate. In this example the drive rotates the axle of at least the receiving roll. The substrate is pulled over the printing area 114 in the direction indicated by the arrow 118.

FIG. 1B is a schematic illustration of flat bed inkjet printer 120 operating with UV curable inks. Printer 120 is a wide format printer 120 printing on a wide rigid substrate 124. The rigid substrate 124 is supported by a table or bed 128 of the printer and travels with it. The substrate 124 is supported by a table 128 which is reciprocal in the direction 118.

In both FIG. 1A and FIG. 1B, a carriage 132 is supported by a support structure 134 over the path of movement of the substrate 108 or 124. The carriage 132 is reciprocal in a direction 146 transverse to the direction 118 of movement of the substrate. In this example the directions 118 and 146 are orthogonal. These two orthogonal movements allow ink droplet deposition at every location of the substrate.

The carriage 132 carries at least one inkjet print head 140 for depositing ink droplets on the substrate, at least one UV source 150 and at least one gas dispenser 156. As shown schematically in FIG. 1B, the, or each, gas dispenser 156 is connected to a gas supply 136 by a gas supply pipe 138. The gas supply 136 is operable to supply to the dispenser(s) inert gas or gas which is at least depleted of oxygen. The dispenser is arranged to provide a layer of gas between the substrate and the area of substrate illuminated by the UV source. The layer of gas is at least depleted of oxygen.

The gas dispenser(s) and the UV source(s) may be in a permanently fixed position(s) relative to the carriage. Alternatively the positions of the gas dispenser(s) and UV source(s) may be adjustable allowing for adjustment to the distance between carriage and UV source(s) and gas dispenser(s) and/or between the UV source(s) and gas dispenser(s).

In alternative embodiments, the substrate may be static and the carriage may move in two orthogonal directions. Examples of printers which have such carriages are the HP 6500 available from the Hewlett Packard Company and the Espedio printer commercially available from Nur Macroprinters, Lod, Israel.

The carriage 132 of the printer of FIG. 1A or 1B has two UV sources 150, two inert gas dispensers 156, and a single print head 140. The print head, gas dispensers and UV sources are aligned in the direction 146 of reciprocation of the carriage. The print head 140 is between one pair made up of a UV source 150A and 1 and a gas dispenser 156A and another pair made up of a gas dispenser 156B and a UV source 150B. When the carriage moves rightwards the print head 140 deposits ink and the UV source 150B cures the deposited ink. When the carriage moves leftwards the print head 140 deposits ink and the UV source 150A cures the deposited ink.

The UV source(s) 150 may each be a UV lamp with hot or cold mirror or a one-dimensional, two-dimensional array, or a three dimensional array of LEDs with suitable wavelength and one or more radiation directing and concentrating elements.

The gas supply 136 may supply to the gas dispenser(s) 156 an inert gas or a gas with low oxygen concentration. For example the gas may be nitrogen.

Figure 2A:
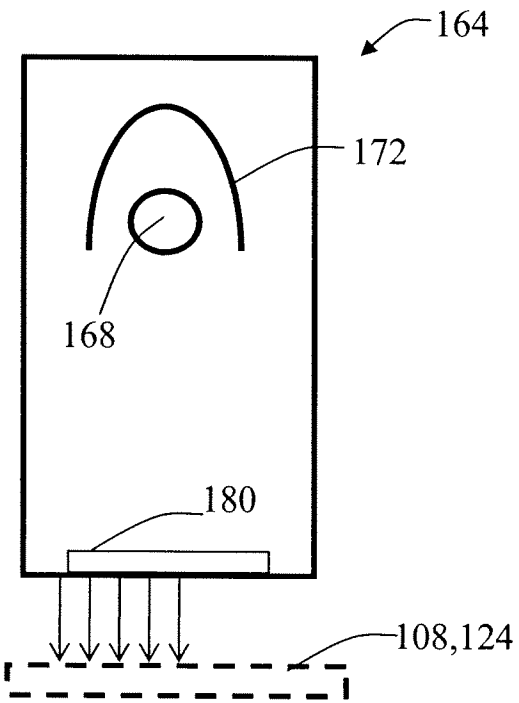
Figure 3C:
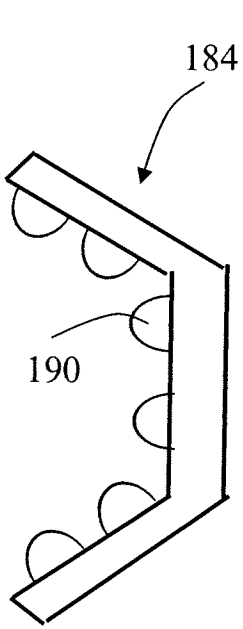
FIGS. 3A through 3D are schematic illustrations of some exemplary embodiments of a LED based curing energy source of the printer of FIG. 1.
Figure 3B:
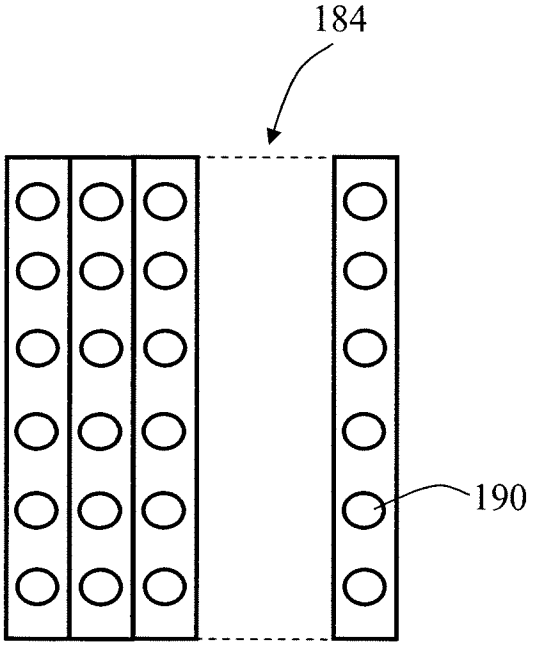
Figure 3A:
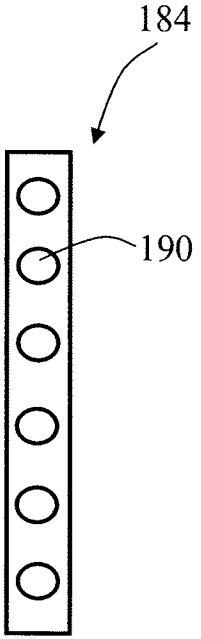
Figure 3D:
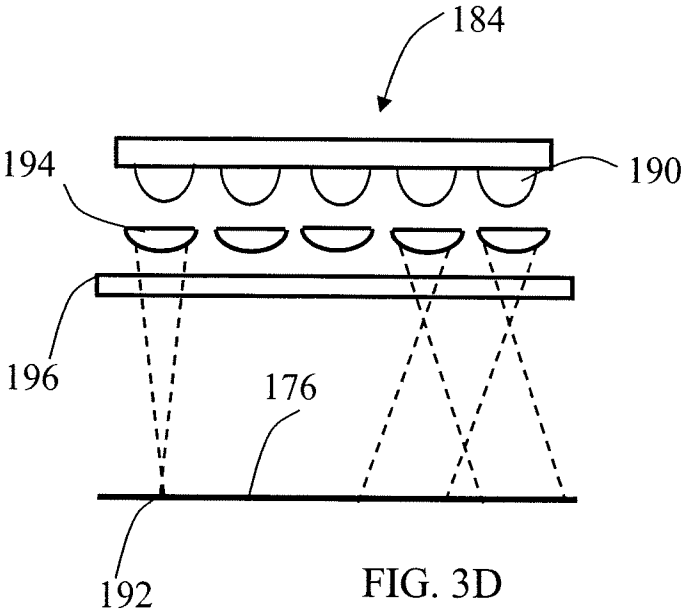

FIGS. 2A and B are schematic illustrations of exemplary embodiments of a UV lamp based curing energy source useful in the printers of FIGS. 1A and 1B. In the embodiment of FIG. 2A, the curing energy source is a UV lamp based source 164. Source 164 may include in addition to lamp 168 a radiation concentrating and directing element such as a reflector 172, directing and concentrating UV radiation to a printed section of substrate 108 or 124 to cure ink droplets on the substrate. In another 1 embodiment shown in FIG. 2B, a mirror 178 is mounted at a proper angle to deflect UV radiation produced by lamp 168 to a printed section 176 (See, e.g., FIG. 3D) of substrate 108 or 124. The flexibility in arrangement of different UV source elements enables proper source construction. An optional protective transparent cover 180 preventing ink mist deposition on UV lamp 168 may be attached to restrict access to the lamp. In one embodiment, lamp reflector 172 may be a hot mirror reflecting infra red (IR) energy and heating up substrate. In another embodiment, where the printing takes place on heat sensitive substrates, lamp reflector 172 may be a cold mirror reflecting UV energy only and transmitting IR energy such that it does not heat the substrate 108 or 124. In an alternative embodiment, mirror 178 may be a cold or hot mirror. In an yet another alternative embodiment, the protective cover 180 may be oriented and coated by proper coating to act as a cold or hot mirror/filter.

FIGS. 3A to D are schematic illustrations of some exemplary embodiments of an LED based curing energy source 184 which may be used as the UV source(s) 150 in the printer of FIG. 1A or FIG. 1B. Source 184 may include in addition to a one dimensional (FIG. 3A) or two dimensional (FIG. 3B) or three dimensional (FIG. 3C) array of LEDs 190. One or more cylindrical lenses 194 (FIG. 3D) may be provided for directing and concentrating UV radiation onto the substrate. A protective transparent cover 196 may be used to prevent deposition of ink mist on the lenses and LEDs.

The directing and concentrating element(s) 194, 172, may concentrate the UV radiation into a narrow band 192 of about 500 micron to about 10 mm wide on the substrate 108, 124. Such a band corresponds to the width of a swath of print deposited by the print head. Alternatively, the lenses 190 or other suitable lenses of the mirrors 172 may be arranged to provide a flood illumination covering a larger area of the substrate.

FIGS. 4A1, A2, B1 and B2 are schematic illustrations of exemplary embodiments of gas dispensers useful as the dispensers 156 of FIG. 1A or FIG. 1B. In each Figure the dispenser 156 comprises a supply pipe 138 connected to a nozzle 198. The nozzle directs the gas to the curing area only. The nozzle 198 acts as a flow director spreading gas flow 202 into a layer having at least the width of a section of the illuminated by the UV radiation. In one embodiment, shown in FIGS. 4A1 and 4A2, gas flow 202 is spread by the nozzle 198 over a relatively large surface matching an area 200 illuminated by a UV source 150 and printed swath 204. The nozzle may be arranged to limit any lateral gas spread. In another embodiment, shown in FIGS. 4B1 and 4B2, inert gas flow 202 is concentrated by the nozzle 198 in a narrow strip type layer 206 matching the width of the band 192 illuminated by UV radiation provided in this example by an LED array 184 focused by concentrating and directing element 194. The width 208 of strip 206 may be in the range from about 500 micron to 10 mm. In an embodiment the nozzle has a narrow slit with a width in the range about 0.5 mm to about 3 mm and the swath of print has a width equal to or less than the width of the slit.

FIG. 5 is a schematic illustration of another embodiment of a printing or coating apparatus. The apparatus comprises a printing or coating station at which a device 234 prints on a substrate 232 or applies a coating to the substrate as the substrate moves in the direction indicated by the arrow 118. The printing or coating device 234 may be any known means such as a coating roller, a sprayer, a static wide array of inkjet print heads. The apparatus further comprises a curing station downstream of the coating station. In this example the curing station comprises a carriage 226, supported by a carriage support structure 134', and which is arranged to reciprocate in a direction 146 transverse to the direction 118 of movement of the substrate. The carriage 226 carries at least one UV source 228 and at least one gas dispenser 230 for dispensing inert gas. The example shown in FIG. 5 comprises two UV sources, one each side of a gas dispenser 230. The UV source(s) and the gas dispenser(s) cure print or a coating applied at the printing or coating station. Numeral 236 marks a coated but un-cured section of the substrate 232 upstream of the curing station, and numeral 238 marks a coated and cured section of the substrate 232 downstream of the curing station.

The apparatus of FIG. 5 may be used to pre-treat a substrate by applying a cured coating to it before printing takes place on the coated substrate. The printing may be done by a printer as shown in FIG. 1A or B as described hereinabove.

FIG. 6 is a schematic illustration of another exemplary embodiment of printing or coating apparatus. The apparatus comprises a printing or coating station at which a device 234 prints on a substrate 232 with UV curable ink or applies a UV curable coating to the substrate as the substrate moves in the direction indicated by the arrow 118. The printing or coating device 234 may be any known means for example a coating roller, a sprayer, or a static wide array of inkjet print heads. The apparatus further comprises a curing station downstream of the coating station. The curing station comprises a UV source 240 coupled with an inert gas dispenser 250. The UV source and the gas dispenser cure print or a coating applied at the printing or coating station. The UV source 240 has a length, in the direction transverse to the direction 118, equal to or greater than the width of the section 236 of the substrate 232 which is coated by or printed with a UV curable coating or ink. The UV source may be an assembly of lamps or an array of LEDs. Inert gas dispensed by the dispenser 250. The dispenser in this example is upstream of the UV source. The dispenser has a length, in the direction transverse to the direction 118, equal to or greater than the width of the section 236 of the substrate 232 which is coated by or printed with a UV curable coating or ink. The dispenser 250 concentrates gas flow 254 into a narrow strip 258 extending across the width of the substrate 232 reducing the power of the UV source required for curing of the coating, or supporting an increase in coating and curing speed. Numeral 236 denotes the coated but un-cured section of the substrate 232 upstream of the curing station, and numeral 238 denotes a coated and cured section of the substrate 232 downstream of the curing station.

FIG. 7 schematically illustrates a modification 132' of the carriage 132 of the printer 100 or 120 of FIG. 1A or 1B. The carriage carries a print head 140 placed between two UV sources 150, and two gas dispensers 156, the print head 140 and UV sources 150 being between the dispensers 156. The dispensers have nozzles 198 directed inwards to produce a layer of oxygen depleted gas under the carriage 132'. In this example the dispensers introduce inert gas 270 under the print head 140 and the UV sources 150 generating one continuous oxygen depleted layer 282 which is shown in FIG. 7 over the substrate 290. Layer 282 reduces if not eliminates contact of the ink with oxygen and reduces the UV power required for ink curing.

FIG. 8 is a schematic illustration of another example of a carriage 132' useful in the printer 100 or 120 of FIG. 1A or 1B. The carriage is arranged to reciprocate in the direction 146. It carries two UV sources 150 spaced apart by two print heads 332 between which is a gas dispenser 320. In this example printing and ink curing take place in a continuous oxygen depleted layer. Gas, for example Nitrogen, is supplied through the dispenser 320 towards substrate 290. The gas spreads in directions indicated by arrows 324 and 328 and fills the space beneath print heads 332 and UV sources 150 generating a continuous oxygen depleted layer. The dispenser in this example is a duct 320.

The method of printing with printer 100 of FIG. 1A of printer 120 of FIG. 1B will be explained now. Printer 100 prints with, for example, UV curable ink such as HP UV 100 Supreme or UV 200 Supreme. Carriage 132 with print head 140 reciprocates over substrate 108 or 124 and deposits a swath 204 of ink droplets in an image wise manner. Inert gas is supplied by dispensers 156 to generate an oxygen-depleted layer over the ink droplets deposited on substrate 108 or 124. The oxygen depleted layer over the ink reduces, or may prevent ink-oxygen inhibiting curing of the ink and may reduce by about ten times the UV power required to cure the printed ink droplets. This increase of sensitivity of the uncured ink layer allows significant reduction of the UV power required for ink curing. It allows reduction in the UV lamp or LED power and/or allows an increase in printing speed. Movement of substrate and/or print head allows deposition of ink droplets on any section of substrate to form an image of a desired size in a desired position.

The above-disclosed UV curing method and UV source and gas dispensing arrangements supporting low power UV curing may be used on a regular offset press with an inkjet print head or an array of print heads to cure varnish deposited by inkjet print heads.

Reduction in the power of the curing radiation sources allows increase in the printer throughput. It also allows use of lower power UV sources further reducing the cost of the printer and increasing printing profitability.

Providing a reciprocal carriage which carries at least one print head, at least one UV source and at least one gas dispenser in close proximity provides a compact apparatus in which the generation of the oxygen depleted layer takes place almost simultaneously with the operation of the UV source and allows the gas to be dispensed accurately under the UV source and print head. Providing two UV sources and dispensers with a print head between them allows efficient operation when the carriage reciprocates.

The invention claimed is:

1. An inkjet printing apparatus to print on a substrate, the apparatus comprising:

a first support which is a substrate support; and a second support supporting at least one inkjet printing head, at least one UV source of ultraviolet radiation, and at least one gas dispenser, the at least one inkjet printing head coupled to the at least one UV source, or the at least one gas dispenser, or both, wherein the UV source comprises a UV lamp and a reflector to concentrate and direct the ultraviolet radiation from the UV source onto the substrate, the second support being moveable relative to the substrate supported by the first support to deposit ink on the substrate and to cure the deposited ink, the at least one gas dispenser having a nozzle to direct a flow of oxygen-depleted gas under the at least one UV source and to provide a layer of oxygen-depleted gas between the UV source and the deposited ink.

2. Apparatus according to claim 1, wherein the first support is fixed and comprises a drive operable to move the substrate, relative to the first support, in a first direction, and the second support is a carriage for reciprocal movement in a second direction orthogonal to the said first direction.

3. Apparatus according to claim 2, wherein the at least one UV source comprises first and second UV sources, wherein the at least one inkjet printing head is positioned between the first and second UV sources, the inkjet printing print head and the first and second UV sources being aligned in the said second direction, and wherein the at least one gas dispenser comprises first and second gas dispensers, the inkjet printing head and the first and second UV sources disposed between the first and second gas dispensers, the first and second gas dispensers arranged to provide a continuous layer of oxygen-depleted gas under the at least one inkjet printing head and the first and second UV sources and between the carriage and the substrate.

4. The apparatus of claim 3 wherein the first and second gas dispensers each has a bent-tipped nozzle, wherein bent tips of the nozzles are to face toward each other to provide the layer of oxygen-depleted gas.

5. Apparatus according to claim 1, wherein positions of the UV source and the gas dispenser are adjustable relative to the inkjet printing head.

6. Apparatus according to claim 1, wherein the reflector comprises a mirror and the apparatus further comprising a transparent cover positioned to prevent ink from being deposited on the UV lamp.

7. Apparatus according to claim 1, wherein the nozzle has an angled end and is to direct the flow of oxygen-depleted gas to a portion of the substrate illuminated by the UV source, a width of the layer of oxygen-depleted gas to correspond with a width of UV source illumination.

8. A method of inkjet printing on a substrate, the method using the apparatus of claim 1, the method comprising:

during a movement of the second support relative to the substrate, using the inkjet printing head to deposit ink on the substrate and curing the deposited ink using the UV source while the inkjet printing head prints on the substrate and the gas dispenser dispenses gas to provide the layer of oxygen-depleted gas between the UV source and the deposited ink.

9. An inkjet printing apparatus to print on a substrate, the apparatus comprising:

a first support which is a substrate support; and a second support supporting at least one inkjet printing head, at least one UV source of ultraviolet radiation, and at least one gas dispenser, the at least one inkjet printing head coupled to the at least one UV source, or the at least one gas dispenser, or both, the second support being moveable relative to the substrate supported by the first support to deposit ink on the substrate and to cure the deposited ink, the at least one gas dispenser having a nozzle to direct a flow of oxygen-depleted gas under the at least one UV source and to provide a layer of oxygen-depleted gas between the UV source and the deposited ink, wherein the nozzle has an angled end and is to direct the flow of oxygen-depleted gas to a portion of the substrate illuminated by the UV source, a width of the layer of oxygen-depleted gas to correspond with a width of UV source illumination, wherein the nozzle has a width in the range of from 500 microns to 10 mm.

10. Apparatus for applying material to a substrate, the apparatus comprising:

a drive operable to move the substrate in a first direction;

a coating station to apply a curable material to the substrate as the substrate moves in the first direction; and a carriage carrying at least two UV sources of ultraviolet radiation to cure the curable material, and at least one gas dispenser coupled to the UV sources to provide a layer of gas, which is at least depleted of oxygen, between the UV sources and the substrate, one of the UV sources coupled to one side of the gas dispenser and the other of the UV sources coupled to an opposing side of the gas dispenser, the carriage spaced apart from the coating station in the first direction and being reciprocal in a second direction orthogonal to the said first direction.

11. The apparatus of claim 10 wherein the coating station is to apply a coating to the substrate, and the UV sources are to cure the coating, the apparatus further comprising a print head to deposit ink on the cured coating.

* * * * *